US012018441B2

(12) United States Patent
Mashek et al.

(10) Patent No.: US 12,018,441 B2
(45) Date of Patent: Jun. 25, 2024

(54) MILLING MACHINE PERFORMANCE MONITORING SYSTEMS AND METHODS

(71) Applicant: Caterpillar Paving Products Inc., Brooklyn Park, MN (US)

(72) Inventors: Nathan L. Mashek, Albertville, MN (US); Eric S. Engelmann, Delano, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 460 days.

(21) Appl. No.: 17/325,001

(22) Filed: May 19, 2021

(65) Prior Publication Data

US 2022/0372716 A1 Nov. 24, 2022

(51) Int. Cl.
*E01C 23/01* (2006.01)
*E01C 23/088* (2006.01)

(52) U.S. Cl.
CPC ..... *E01C 23/01* (2013.01); *E01C 23/088* (2013.01)

(58) Field of Classification Search
CPC ..... E01C 23/01; E01C 23/088; E01C 23/00; G01M 99/005; G01M 99/008
See application file for complete search history.

(56) References Cited

U.S. PATENT DOCUMENTS

| | | | | |
|---|---|---|---|---|
| 9,121,146 | B2 | 9/2015 | Paulsen et al. | |
| 9,879,386 | B2 | 1/2018 | Marsolek | |
| 9,938,674 | B2 | 4/2018 | Engelmann et al. | |
| 10,386,866 | B2 | 8/2019 | Delong et al. | |
| 10,794,010 | B2 | 10/2020 | Berning et al. | |
| 10,829,899 | B2 | 11/2020 | Sturos | |
| 11,679,639 | B2 * | 6/2023 | Rife, Jr. | B60G 17/0165 701/38 |
| 2011/0121633 | A1 | 5/2011 | Hall et al. | |
| 2012/0175938 | A1 | 7/2012 | Arcona et al. | |
| 2016/0040370 | A1 | 2/2016 | Paulsen et al. | |
| 2016/0340842 | A1 * | 11/2016 | Adams | E01C 23/01 |

* cited by examiner

*Primary Examiner* — Yonel Beaulieu

(57) ABSTRACT

A method for determining and monitoring output of a milling machine comprises sensing an operating parameter of a milling machine with a sensor, transmitting data from the sensor of the milling machine to an off-board location, determining a performance parameter of the milling machine from the data at the off-board location, transmitting the performance parameter to the milling machine, and displaying the performance parameter on a display screen of the milling machine.

20 Claims, 9 Drawing Sheets

MILLING MACHINE PERFORMANCE MONITORING SYSTEMS AND METHODS

TECHNICAL FIELD

The present application relates generally, but not by way of limitation, to sensor systems and methods for road milling machines, such as those that can be used to remove paved surfaces. More particularly, the present application relates to productivity tracking and performance monitoring systems and methods for such machines.

BACKGROUND

Asphalt-surfaced roadways are built to facilitate vehicular travel. Depending upon usage density, base conditions, temperature variation, moisture levels, and/or physical age, the surfaces of the roadways eventually become misshapen or degraded and unable to support wheel loads from vehicles. In order to rehabilitate the roadways for continued vehicular use, spent asphalt is removed in preparation for resurfacing with new asphalt.

Cold planers, sometimes also called road mills or scarifiers, are used to break up and remove layers of an asphalt roadway during a resurfacing operation. A cold planer typically includes a frame propelled by tracked or wheeled drive units. The frame supports an engine, an operator station, a milling drum, and conveyors. The milling drum, fitted with cutting bits, is rotated along an axis through a suitable interface with the engine to break up the surface of the roadway. The broken-up roadway material is deposited by the milling drum onto the conveyors, which transfer the broken-up material into haul trucks for removal from the worksite. A paving machine follows behind the cold planer at a desired distance and covers the milled surface with fresh asphalt. Haul trucks carrying fresh, hot asphalt from an asphalt plant periodically pass between the paving machine and the cold planer to deliver additional asphalt to the paving machine. This process repeats until the resurfacing operation is finished.

It can be useful for paving contractors to monitor progress of various resurfacing operations. For example, it can be useful to know the volume or tonnage of spent asphalt that has been milled to, for example, coordinate incoming asphalt for the paving machine. However, gathering useful data from resurfacing operations typically requires the use of a plurality of sensors and onboard computing capabilities of the various paving train machines, which increases the cost and complexity of the machines.

U.S. Pat. No. 9,121,146 to Paulsen et al. entitled "Determining Milled Volume or Milled Area of a Milled Surface" and U.S. Pat. No. 10,829,899 to Sturos entitled "Partial-Cut-Width Sensing for Cold Planar" relate to road milling machines.

SUMMARY OF THE INVENTION

A system for determining and monitoring output of a milling machine can comprise a cutting system having a cutting tool extending across a cutting path about a rotational axis, a sensor positioned on the milling machine to sense a performance parameter of the cutting tool and generate raw sensor data, a communication device electronically coupled to the sensor to receive the raw sensor data and transmit the raw sensor data outside of the milling machine, and a monitoring device located apart from the milling machine and can be configured to receive the raw sensor data and evaluate performance of the milling machine.

A method for determining and monitoring output of a cold planer machine can comprise sensing an operating parameter of a milling machine with a sensor, transmitting data from the sensor of the milling machine to an off-board location, determining a performance parameter of the milling machine from the data at the off-board location, transmitting the performance parameter to the milling machine, and displaying the performance parameter on a display screen of the milling machine.

DETAILED DESCRIPTION

Figure 1:
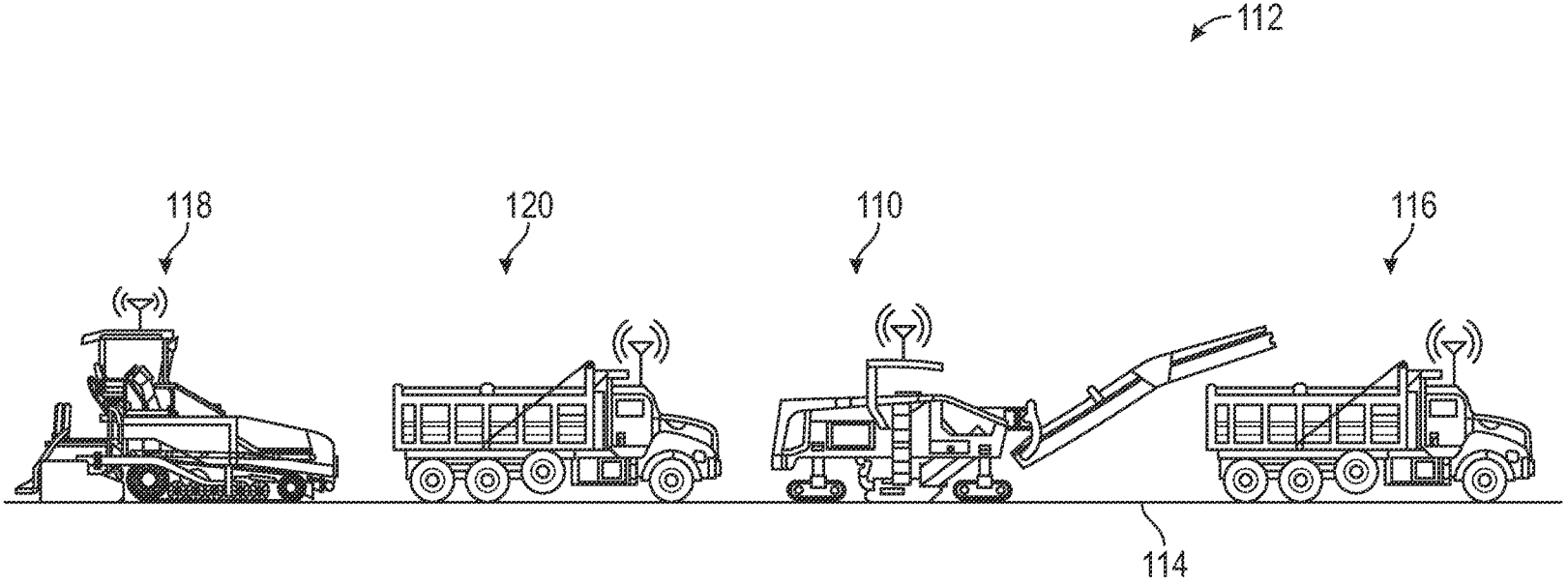
FIG. 1 illustrates an exemplary jobsite of a resurfacing operation having exemplary milling and paving machines.

FIG. 1 shows milling machine 110, such as a cold planer or rotary mixer, employed at worksite 112, such as, for example, a roadway resurfacing operation. As part of the resurfacing operation, milling machine 110 can mill surface 114 of the roadway and transfer milled material into one or more first haul trucks 120 (only one shown). When full, haul trucks 120 can depart from milling machine 110 to deliver the milled material to a storage site (not shown), and an empty haul truck 120 can approach milling machine 110 to replace a full haul truck 120 to allow for a continuous milling process.

Paving machine ("paver") 118 can follow behind milling machine 110 and deposit a layer of paving material, such as fresh asphalt, onto surface 114 after it has been milled by milling machine 110. One or more second haul trucks 116 (only one shown) can periodically pass between paving machine 118 and milling machine 110 to deliver additional fresh asphalt to paving machine 118 to allow for a continuous paving process. Additional haul trucks 116 containing fresh asphalt can be summoned from an asphalt plant (not shown) or dispatch facility when it is determined that additional asphalt is needed.

As discussed herein, milling machine 110 can comprise one or more sensors that can gather one or more of operating and performance parameters of milling machine 110 for transmitting off-board of milling machine 110 for evaluation by an off-board computing system, such as a mobile computing device, another milling or paving machine or a backroom office.

Figure 2:
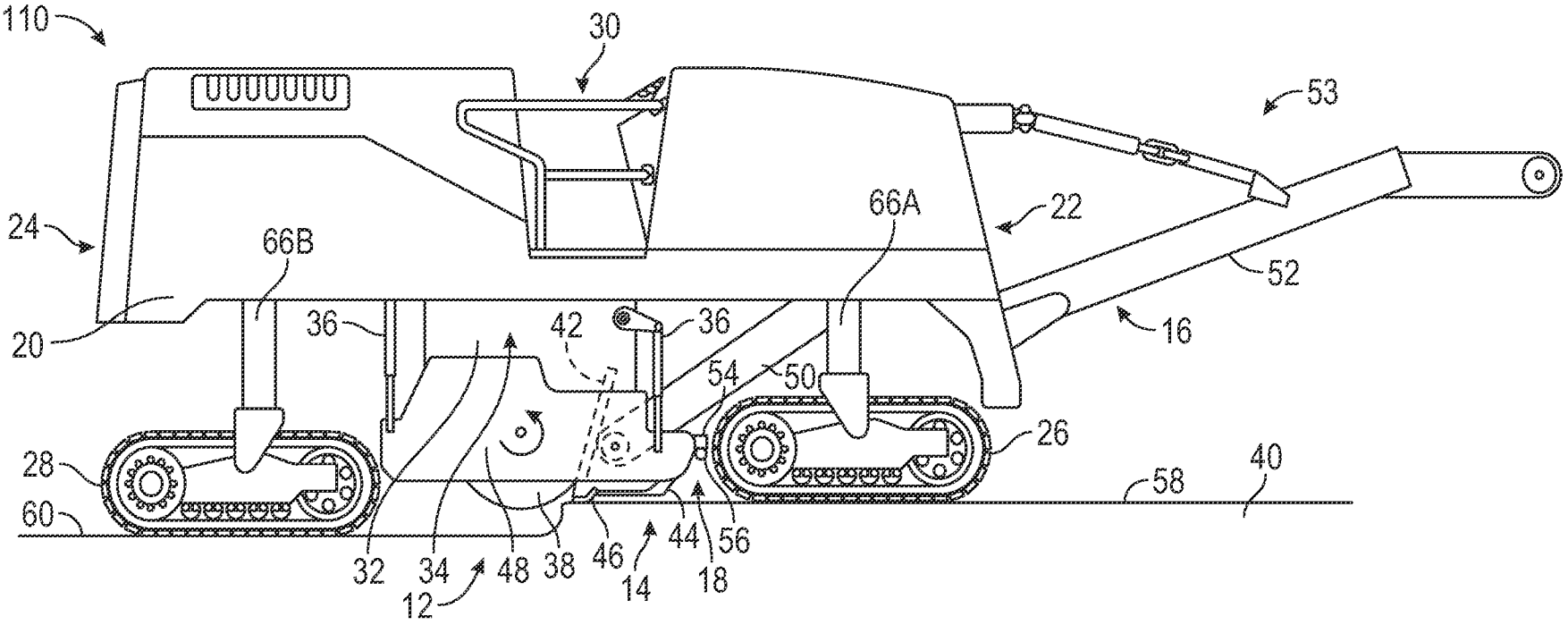
FIG. 2 is a schematic side view of a milling machine showing a cutting system, an anti-slabbing system, a conveyor system and a partial-cut-width sensor system.

FIG. 2 is a schematic side view of milling machine 110 showing cutting system 12, anti-slabbing system 14, conveyor system 16 and partial-cut-width sensor system 18.

Milling machine 110 can further comprise frame 20 comprising front frame end 22 and back frame end 24. Front propulsion elements 26 and back propulsion elements 28 can be coupled to frame 20 proximate front frame end 22 and back frame end 24, respectively. Each of propulsion elements 26 and 28 can include two parallel ground engaging tracks, although the present disclosure is not thereby limited. Operator control station 30 can be coupled to frame 20 and can comprise controller 344 (FIG. 10) for performing control and monitoring functions of milling machine 110. Cutting system 12 can be coupled to frame 20 and can comprise housing 32 defining cutting chamber 34 for rotatable cutter drum 38. Elevation control legs, or support posts, 66A and 66B can be provided to raise and lower housing 32, including chamber 34 with cutter drum 38, typically in conjunction with adjustments to a cutting depth of cutting system 12. Side plate cylinders 36 can be configured to adjust the height of side plate 48. Cutting system 12 can include a cutting tool, such as rotatable cutter drum 38 that can rotate in a direction counter to a forward travel direction of milling machine 110. Rotatable cutter drum 38 can be fixed within housing 32 and configured to cut material of mat or substrate 40 underlying milling machine 110. Substrate 40 can comprise surface 114 of FIG. 1.

Anti-slabbing system 14 can be coupled to housing 32 of chamber 34 and can include an upwardly oriented base plate 42 extending across a front side of cutting chamber 34, a forwardly projecting plow 44 for pushing loose material lying upon substrate 40, and a plurality of skids 46. Sides of cutting chamber 34 adjacent a cutting tool for cutting system 12 can be enclosed by side plates 48.

Primary conveyor 50 can be positioned forward of base plate 42 and can be coupled to and supported upon base plate 42. Primary conveyor 50 can feed material cut from substrate 40 via rotatable cutter drum 38 to secondary conveyor 52 projecting forward of frame end 22. Positioning mechanism 53 can be coupled to secondary conveyor 52, to enable left, right, and up and down position control of secondary conveyor 52. Secondary conveyor 52 can deposit removed substrate 40 into a receptacle, such as the box of a dump truck.

Milling machine 110 can also be equipped with partial-cut-width sensor system 18 for determining how much of the width of cutting system 12 (into the plane of FIG. 2) is cutting substrate 40. Partial-cut-width sensor system 18 can include mounting bar 54 and sensor array 56. In the example of FIGS. 2-5, partial-cut-width sensor system 18 can comprise a plurality of discrete distance sensors located at intervals across the cutting width of cutter drum 38. However, other types of partial-cut-width sensor systems can be used, such as those described with reference to FIGS. 6-9, as well as others. Data collected by partial-cut-width systems described herein, as well as other information collected by milling machine 110, can be transmitted off-board of milling machine 110 for processing and evaluating at locations outside of milling machine 110, thereby saving milling machine 110 from having to include expensive data processing hardware and software having to be frequently updated.

Milling machine 110 can drive over substrate 40 such that front propulsion elements 26 roll on surface 58 (e.g., surface 114 of FIG. 1). Milling machine 110 can be configured to remove substrate 40 from a roadway to leave surface 60 behind. Back propulsion elements 28 can roll on surface 60, with cutting system 12 producing an edge of substrate 40 between surfaces 58 and 60. Surface 60 can comprise a surface from which paving material has been completely removed or a surface of paving material from which an upper-most layer of paving material has been removed.

Milling machine 110 can be configured to travel in a forward direction (from left to right with reference to FIG. 2) to remove substrate 40. Anti-slabbing system 12 can travel over the top of substrate 40 to prevent or inhibit substrate 40 from becoming prematurely dislodged during operations for removal of substrate 40. Rotatable cutter drum 38 can follow behind anti-slabbing system 14 to engage substrate 40. Rotatable cutter drum 38 can be configured to rotate counter-clockwise with reference to FIG. 2 such that material of substrate 40 can be uplifted and broken up into small pieces by cutting teeth of rotatable cutter drum 38. Anti-slabbing system 14 can be configured to contain pieces of substrate 40 within cutting chamber 34. Removed pieces of substrate 40 are pushed up primary conveyor 50 and carried forward, such as by an endless belt, to secondary conveyor 52. Secondary conveyor 52 can be cantilevered forward of front frame end 22 to be positioned over a collection vessel, such as the box of a dump truck.

In order to evaluate the operation and performance of milling machine 110, milling machine 110 can be outfitted with a plurality of sensors. For example, it can be desirable to evaluate productivity measurements of milling machine 110 in real-time or at the end of an operation. For example, milling machine 110 can be configured to remove a certain depth of substrate 40 (e.g., the difference in height between surfaces 58 and 60). As such, milling machine 110 can include systems for determining a cutting depth of cutting system 12 to, for example, distinguish between cut and uncut pavement. In combination with the speed of milling machine 110 and the width of cutting system 12, the volume of substrate 40 removed for a given period of operation can be determined. Roadways are typically multiple times wider than the width of milling machine 110. As such, multiple passes of milling machine 110 can be used to remove the complete width of substrate 40. However, not all passes of milling machine 110, particularly the last pass, extend across a width of substrate 40 that takes up the full width of cutting system 12 (e.g., the width of cutter drum 38). If the partial-cut-width is not taken into account, material removal volume calculations can become skewed, particularly when long stretches of roadway material are being removed. Partial-cut-width sensor system 18, and others described herein, can be configured to sense how much of the width of cutting system 12 is actually cutting substrate 40 to increase accuracy of productivity evaluations of cutting system 12 of milling machine 110 that can be completed off-board of milling machine 110 to reduce hardware and software requirements of milling machine 110.

Figure 3:
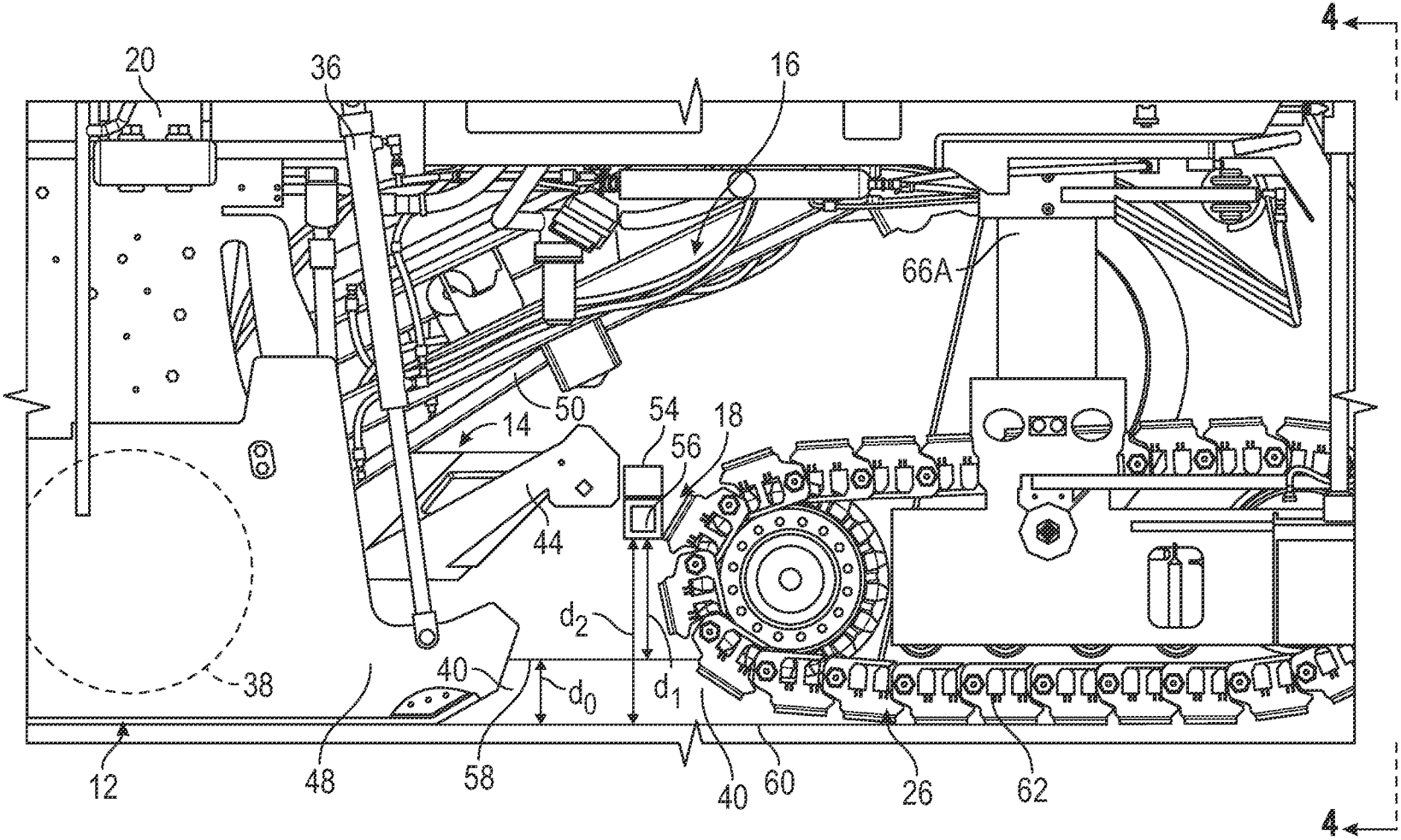
FIG. 3 is a diagrammatic side view of the cutting system, anti-slabbing system, conveyor system and partial-cut-width sensor system of FIG. 2 showing differences in depth of matted and milled roadway surfaces.

FIG. 3 is a diagrammatic side view of cutting system 12, anti-slabbing system 14, conveyor system 16 and partial-cut-width sensor system 18 of FIG. 2 showing differences in depth of matted roadway surface 58 and adjacent milled roadway surface 60.

Cutting system 12 can comprise rotatable cutter drum 38 positioned behind side plate 48. Side plate 48 can be attached to housing 32 defining chamber 34. Anti-slabbing system 14 can be coupled to housing 32 defining chamber 34 forward of cutter drum 38. Anti-slabbing system 14 can comprise plow 44, to which are mounted skids 46 (FIG. 5) and base plate 42 (FIG. 2). Primary conveyor 50 can be coupled to anti-slabbing system 14 and can extend from a first end proximate anti-slabbing system 14 to a second end forward of anti-slabbing system 14 within machine 10. Propulsion element 26, which can comprise endless track 62, can be coupled to frame 20 by elevation control leg 66A. Elevation control leg 66A can be operated by controller 344 (FIG. 10) of milling machine 110 to change the position of frame 20 relative to substrate 40 to, for example, assist in changing the cutting depth of cutting system 12. Mounting bar 54 of partial-cut-width sensor system 18 can be mounted within milling machine 110 in front of cutting system 12 to position sensor array 56 across substrate 40. In an example, mounting bar 54 can be directly connected to frame 20. Additionally, mounting bar can be attached indirectly to frame 20, such as by attachment to an upper portion of anti-slabbing system 14, as shown, for example, in FIGS. 3-5. However, in other examples, a mounting bar can be attached to frame indirectly, such as through a lower portion of anti-slabbing system 14.

Although shown in an elevated position above substrate 40 in FIG. 3, anti-slabbing system 14 can be lowered to rest on top of substrate 40 at surface 58. Likewise, propulsion element 26 is shown resting on milled roadway surface 60, but can be configured to engage matted roadway surface 58 in operation. Cutting system 12 can be lowered such that side plate 48 rests on previously milled roadway surface 60 adjacent to substrate 40. As propulsion element 26 moves milling machine 110 (to the right with reference to FIG. 3) along substrate 40, cutter drum 38 engages an edge of substrate 40. During a full width pass, substrate 40 can extend all the way across cutter drum 38 between side plates 48. As such, a volume calculation of removed substrate 40 can comprise a depth measurement for depth $d_0$ (equal to the difference in distances $d_1$ and $d_2$ for surfaces 58 (114) and 60), a width measurement of cutter drum 38 and a travel distance measurement of milling machine 110. As such, only the depth measurement from the cut-depth sensor 360*c* (FIG. 10) or control system would be required. However, not all milling operations involve cutting substrate 40 across the full width of cutter drum 38. As such, sensor array 56 can include a plurality of sensors spaced across the width of milling machine 110 to determine the proportion of the width of cutter drum 38 that is removing substrate 40.

Figure 4:
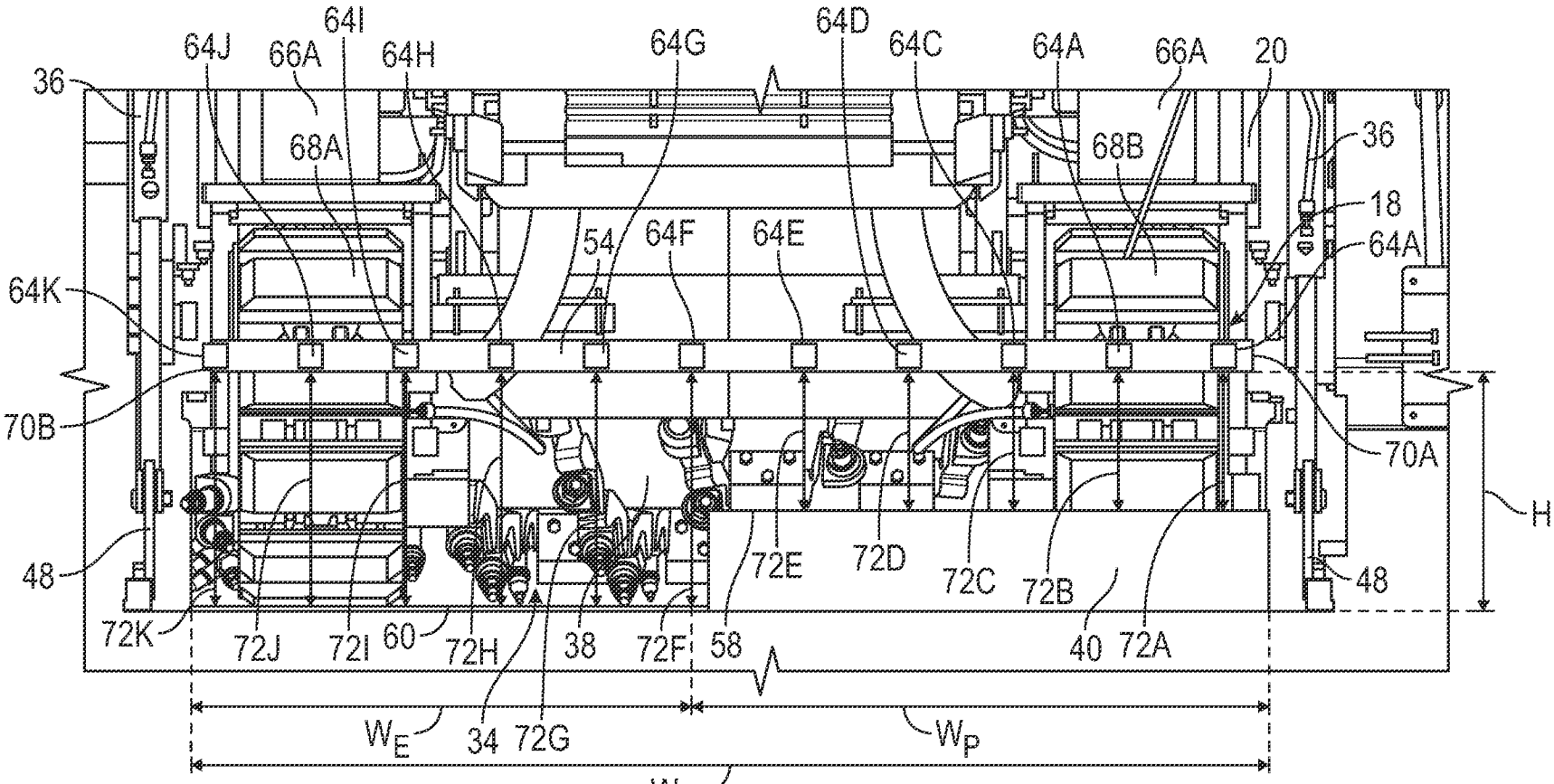
FIG. 4 is a diagrammatic front view of the partial-cut-width sensor system of FIG. 3 showing the location of individual sensors relative to a width of a cutter drum and matted and milled roadway surfaces.

FIG. 4 is a diagrammatic front view of partial-cut-width sensor system 18 of FIG. 3 showing the location of individual depth sensors 64A-64K relative to a width $W_0$ of cutter drum 38 and matted roadway surface 114 and milled roadway surface 60. In FIG. 4, partial-cut-width sensor system 18 is illustrated in front of propulsion element 26 for clarity, though, in actuality, sensor mounting bar 54 could be located behind propulsion element 26 forward of cutting system 12, as shown in FIG. 3.

Frame 20 of milling machine 110 can support elevation control legs 66A and 66A, which can be used to carry propulsion element 26. Propulsion element 26 can comprise first track 68A and second track 68B. Tracks 68A and 68B can be positioned in front of cutter drum 38 to roll over substrate 40, while cutter drum 38 performs milling operations behind tracks 68A and 68B. As can be seen in FIG. 4, substrate 40 does not always extend all the way across cutter drum 38 between side plates 48. Sensors 64A-64K are positioned on mounting bar 54 (FIG. 5), which can be coupled to frame 20 or anti-slabbing system 14 in a plurality of different ways.

Side plates 48 can be located on opposite sides of cutter drum 38 to define cutting chamber 34. Cutter drum 38 can define cutting or milling width $W_0$. Mounting bar 54 can be attached to milling machine 110 to extend across width $W_0$. For example, mounting bar 54 can be attached to frame 20 using any suitable mounting hardware, such as brackets, fasteners, extensions, straps and the like, or anti-slabbing system 14. Sensors 64A-64K can be positioned across the width of mounting bar 54. For example, sensors 64A-64K can be positioned at regular, predetermined intervals to divide width $W_0$ into segments of a known length that can be stored in a memory device. The position of mounting bar 54 relative to the underside of milling machine 110 can be located in a known or predetermined location. For example, the height H of mounting bar 54 above the bottom of tracks 68A and 68B can be used as a baseline for determining a cutting or milling depth. The locations and lengths of the segments and height H can be stored in memory connected to controller 344 (FIG. 10) and off-board computer 384 (FIG. 10) and can be used to calculate or determine partial-cut-widths of cutter drum 38.

Sensors 64A-64K can sense the distances between mounting bar 54 and the surface that is below each of sensors 64A-64K. Sensor 64A can be located at first end 70A of mounting bar 54 and sensor 64K can be located at second end 70B. Sensor 70F can be located halfway between sensors 64A and 64F. As such, at a minimum, sensors 64A-64K can divide cutting width $W_0$ into two segments. However, in other examples, sensors 64A-64K can divide width $W_0$ into four segments using sensors 64C and 64H. In the example, shown sensors 64A-64F divide width $W_0$ into ten segments. The greater the number of segments that width $W_0$ can be divided into, the greater resolution of the partial-cut-width can be obtained.

Sensors 64A-64K can be fired, or activated, and measurements therefrom can be used in different ways to determine how much of width $W_0$ is actually cutting substrate 40. As shown in FIG. 4, sensors 64A-64K can emit sensor signals 72A-72K that can be used in conjunction with controller 344 or off-board computer 384 (FIG. 10) to determine a relative thickness of substrate 40 being removed by cutter drum 38 at the location of each of sensors 64A-64K. Sensors 64A-64K need not sense an actual thickness of substrate 40, as other sensors, such as sensors 360*c* described with reference to FIG. 10 can provide such function. However, sensors 64A-64K can be configured to sense the thickness of substrate 40 in various examples. Furthermore, sensors 64A-64K need not sense an absolute distance of surfaces 58 and 60 from any specific reference point, as partial-cut-width determinations can be determined only by differences in each of sensor signals 72A-72K relative to each other. Sensor signals 72A-72K can bounce off matted roadway surface 58 or milled roadway surface 60 and return to sensors 64A-64K to provide a distance measurement. In various examples, sensors 64A-64K can comprise acoustic sensors, sonic sensors, laser sensors and the like, or other distance, level, proximity or presence sensors. In an example, sensors 64A-64K can comprise non-contact sonic sensors, however, in various embodiments, contact sensors can be used, such as magnetic coil sensors and sensors incorporating a scale.

In an example, the measurements taken for each of sensors 64A-64K can be averaged together and the average distance measurement can be compared to each individual distance measurement. For differences between the average distance measurement and the individual distance measurement that are less than the average, controller 344 (FIG. 10) or off-board computer 384 (FIG. 10) can determine if substrate 40 is present. For differences between the average distance measurement and the individual distance measurement that are greater than the average, controller 344 (FIG. 10) or off-board computer 384 (FIG. 10) can determine that substrate 40 is not present. For the sensors where substrate 40 is determined to not be present, the portion of width $W_0$ over which those sensors extend $W_E$ can be subtract from width $W_0$ to determine an actual cut width $W_P$. Additionally, a ratio of the sensors sensing depth d1 versus the total number of sensors can be used to determine the partial cut width $W_P$.

In another example, individual sensor measurements can be compared directly to adjacent sensor signals to determine a location along width $W_0$ where substrate 40 ends.

Figure 5:
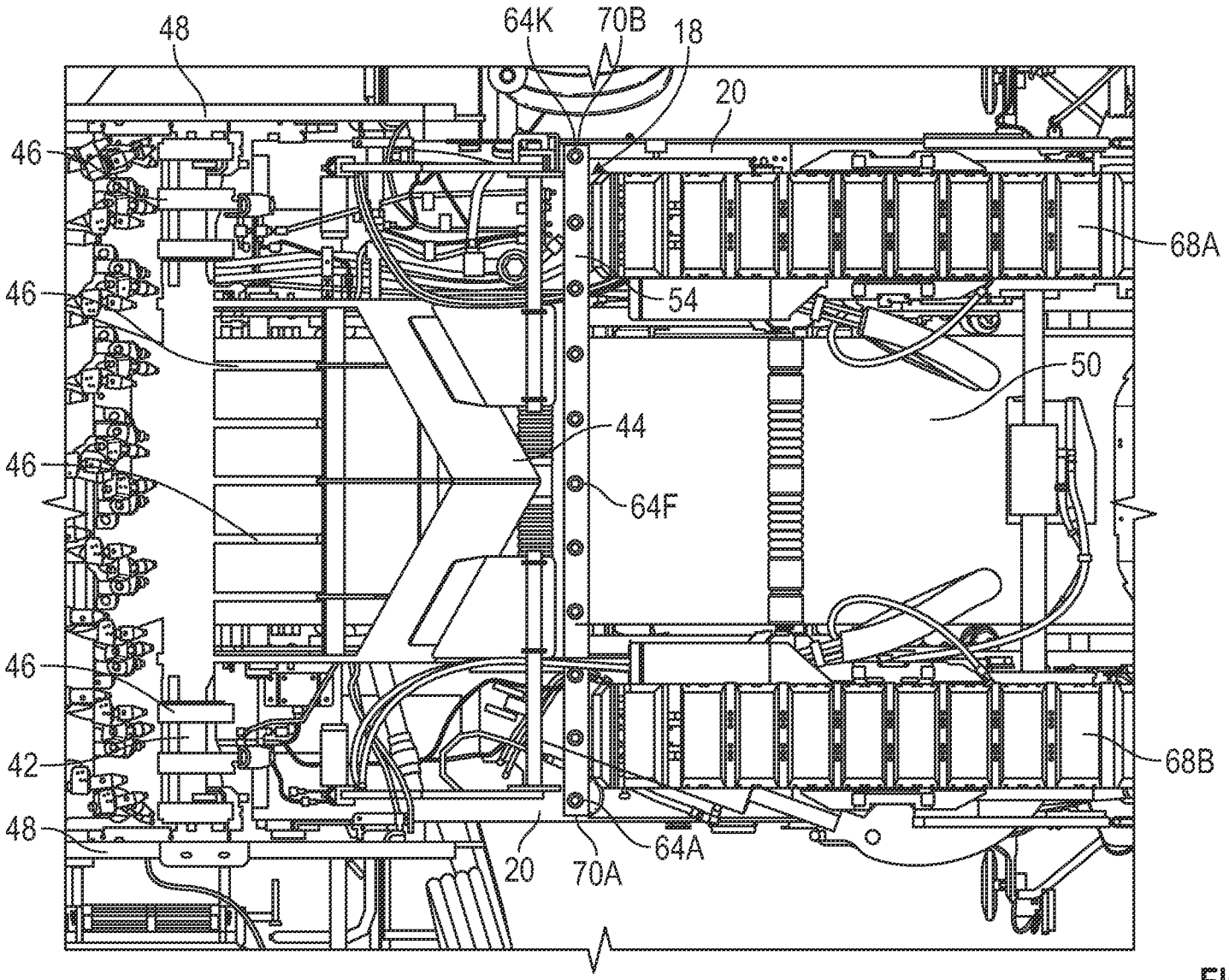
FIG. 5 is a diagrammatic bottom view of the cutting system, anti-slabbing system, conveyor system and partial-cut-width sensor system of FIGS. 3 and 4 showing the location of individual sensors for a partial-cut-width sensor system relative to a frame and cutter drum of the cold planer machine.

FIG. 5 is a diagrammatic bottom view of cutting system 12, anti-slabbing system 14, conveyor system 16 and partial-cut-width sensor system 18 of FIGS. 2-4 showing the location of individual sensors 64A-64K for partial-cut-width sensor system 18 relative to cutter drum 38 of milling machine 110.

Mounting bar 54 can extend across milling machine 110 out front of cutter drum 38. Mounting bar 54 can be attached to frame 20 at first end 70A and second end 70B aft of primary conveyor 50 and propulsion element 26 and forward of anti-slabbing system 14. In additional examples, mounting bar 54 can be attached to the forward portion of plow 44 of anti-slabbing system 14, as shown in FIGS. 2 and 3, or on other locations of anti-slabbing system 14. In other embodiments, a mounting bar of the present application can be mounted to primary conveyor 50, such as on structural components supporting a rotating belt of conveyor 50 that can be supported by frame 20.

FIGS. 2-5 illustrate examples of sensors and systems that can be used to determine, sense or evaluate a partial-cut width. However, other types of devices and systems can be used to determine partial-cut width. FIGS. 6-9 illustrate additional examples of sensor systems for determining partial-cut width of a milling machine, including, for example, laser profile scanners, triangulation sensors, time-of-flight sensors, distance sensors and the like.

Figure 6:
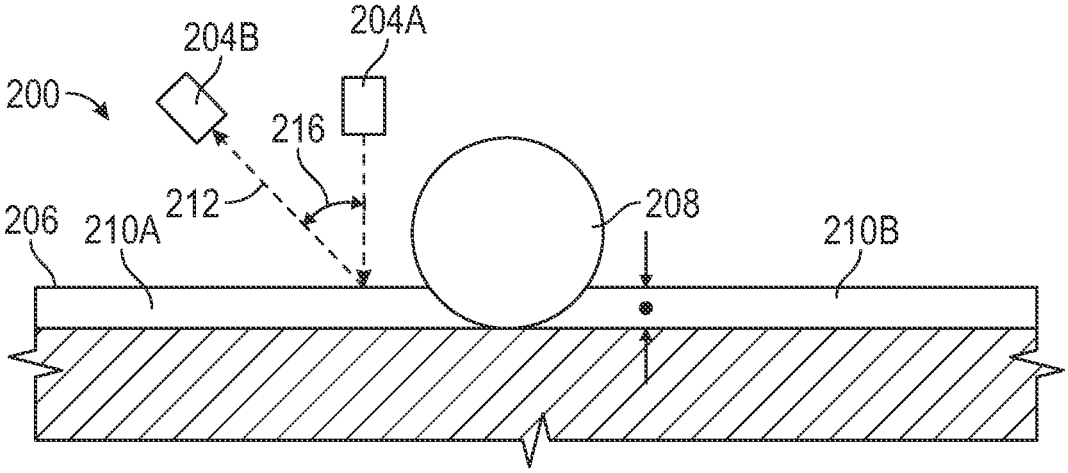
FIG. 6 is a schematic side view of a laser profile scanner system that can be used to perform triangulation-type measurements of partial-cut widths.
Figure 7:
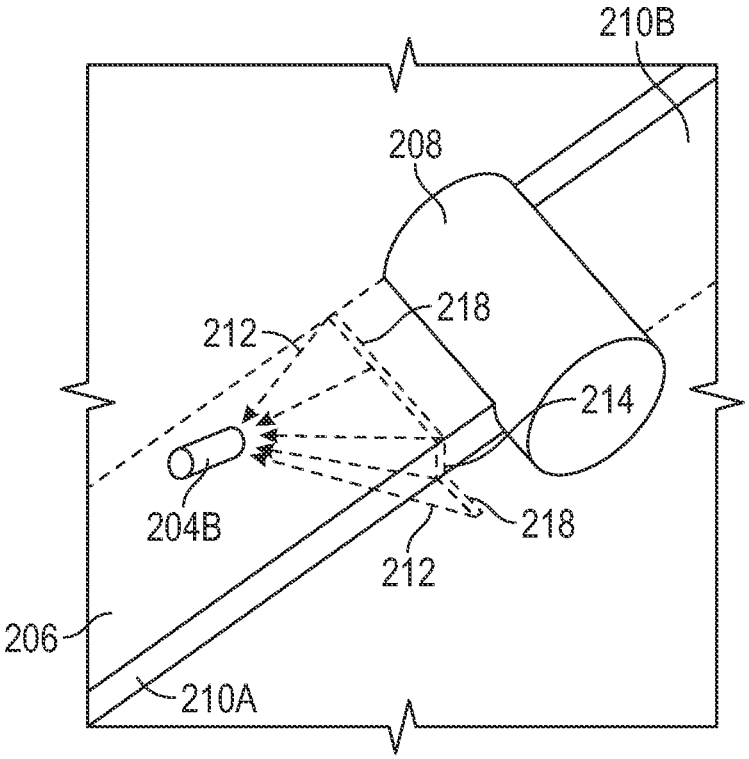
FIG. 7 is a schematic perspective view of the laser profile scanner system of FIG. 6 showing a scanned edge of a partial-cut width strip of paving material.

FIG. 6 is a schematic side elevation view of laser profile scanner system 200 comprising a triangulation-type system. FIG. 7 is a schematic perspective view of scanner system 200 of FIG. 6. FIGS. 6 and 7 are discussed concurrently.

System 200 can comprise first sensor 204A and second sensor 204B. Sensors 204A and 204B can be configured to view ground surface 206 upstream of milling drum 208, such as cutter drum 38. Ground surface 206 can include first edge 210A and second edge 210B. First edge 210A can be a previously cut edge and second edge 210B can be an edge currently being cut by milling drum 208, which can be an instance of cutter drum 38 (FIG. 2). As such first edge 210A can be further into the plane of FIG. 6, as can be seen in FIG. 7.

In examples, first sensor 204A and second sensor 204B can comprise laser profile scanning devices suitable for determining the profile of ground surface 206 in front of milling drum 208. Such scanners can measure distance to objects in at least two different ways. One is the use of triangulation methods, such as is discussed with reference to FIGS. 6 and 7. The other is to directly measure distances using time of flight of reflected signals, such as is discussed with reference to FIG. 8.

The triangulation method is schematically illustrated in FIGS. 6 and 7. FIG. 6 is a side elevation view showing first sensor 204A comprising a laser source and second sensor 204B comprising a receiver. It will be understood that sensor 204A and sensor 204B can also be incorporated into one integral laser profile scanner unit. Source, e.g., sensor 204A, can project laser beam 218 downward onto ground surface 206 directly in front of the advancing milling drum 208. Sensor 204A is not shown in FIG. 7. Reflected light 212 from sensor 204A can be received by sensor 204B.

Due to the previously cut edge 210A, a displacement or step 214 is readily apparent in laser beam 218. Because the exact positions of source, e.g., sensor 204A, and receiver, e.g., sensor 204B, and angle 216 between them are known, the position of the step 214 representing the location of edge 210A, such as relative to edge 210B, can be determined by triangulation. Source, e.g., sensor 204A, and receiver, e.g., sensor 204B, can, alone or with the assistance of controller 344 or off-board computer 384 (FIG. 10), measure the distance between the machine and the surface of the street. The signals can be transformed into a Cartesian coordinate system projected onto ground surface 206. The detection of the step 214 can be achieved by mathematical gradient methods. As such, the position of edge 210A relative to the side of cutter drum 38 proximate edge 210B can be determined to, for example, determine a percentage of the width of milling drum 208 that is actually cutting ground surface 206.

A suitable laser profile scanner for use as described above is the LPS 36 Laser Measurement System available from Leuze electronic GmbH & Co. KG of Owen, Germany.

Figure 8:
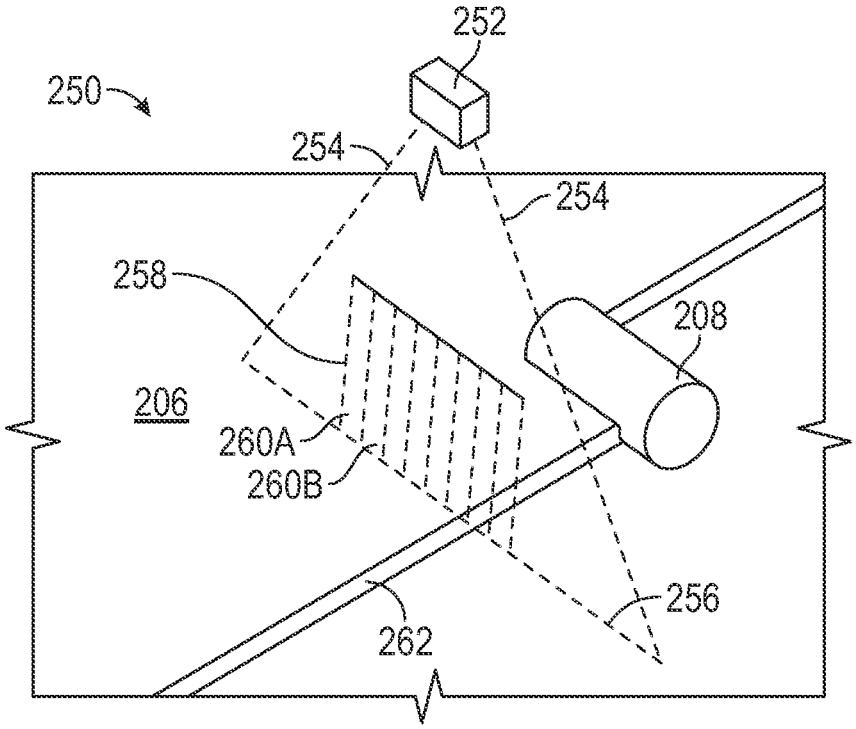
FIG. 8 is a schematic perspective view similar to FIG. 7, showing a laser profile scanner system that can be used to perform time-of-flight measurements of cut depth.

FIG. 8 is a schematic perspective view of scanner system 250 comprising a time-of-flight type of laser or LED scanner system. Scanner system 250 can comprise laser profile scanner 252 that can measure distance via time-of-flight of light reflected therefrom. Laser profile scanner 252 can direct fan 254 of laser light downward in a fan shape to illuminate line 256 on surface 206 in front of milling drum 208. A sensor contained in laser profile scanner 252 can measure time of flight of reflected light to determine the distance to the various points on the ground along line 256. Scanner 252 can have an operating range 258 indicated in dashed lines. Operating range 258 can be divided into columns 260A, 260B, etc. and an internal processor within scanner 252, or coupled to controller 344 or off-board computer 384 (FIG. 10) can evaluate the reflected light and detect the height of the surface within each of its defined columns. Such a scanner can measure the height within each of its columns, and also via the abrupt change in height can identify the location of edge 262 along the width of milling drum 208. One commercially available scanner that can be used as scanner 252 is the LMS100 Laser Measurement System available from Sick, AG of Waldkirch, Germany. Laser and LED scanners as described herein can comprise three-dimensional scanners as compared to the two-dimensional sensors described with reference to FIGS. 3-5.

Figure 9:
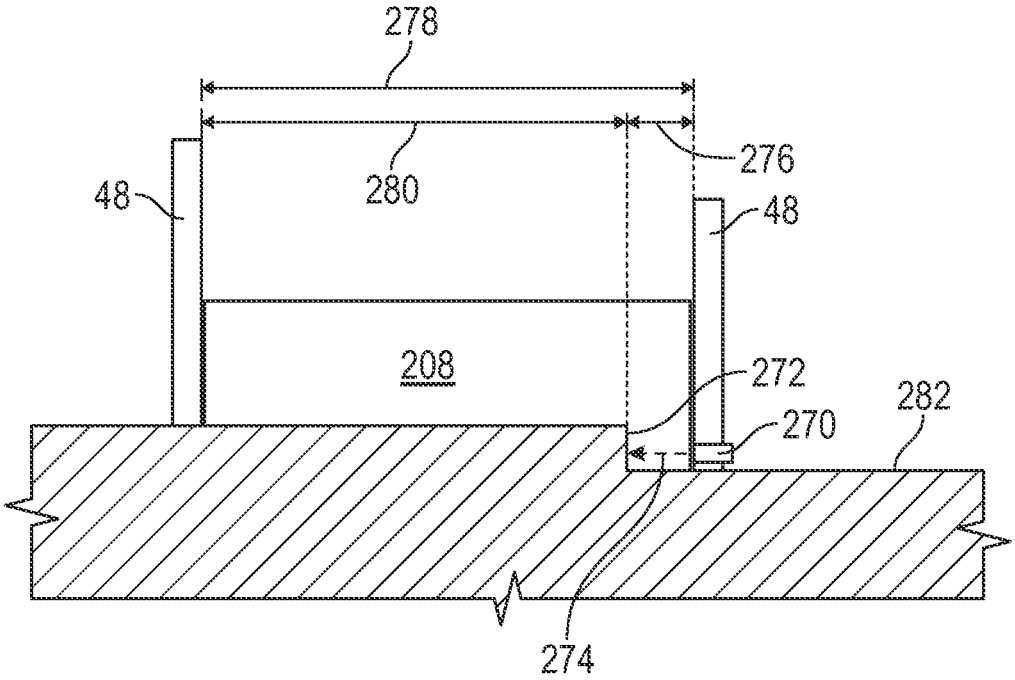
FIG. 9 is a schematic front view of a distance sensor mounted to a side plate of the milling machine of FIGS. 2-5.

FIG. 9 is a schematic front view of distance sensor 270 mounted to one of the side plates 48. The profile parameter measured by sensor 270 can be a more direct measurement of partial-cut width milled in front of milling drum 208. Sensor 270 can emit signal 274 and receive a reflected signal from edge 272 along a path to measure a distance 276 from the edge of the milling drum 208 to the previously cut edge 272. Distance 276 of the path can be a portion of total cut width 278. Distance 276 can be subtracted from total cut width 278 to determine partial-cut width 280.

Sensor 270 can operate based upon several different technologies. Sensor 270 can be a laser-based sensor. Sensor 270 can be an LED-based sensor. Sensor 270 can be based on ultrasonic sensing.

Sensor 270 used to detect the previously cut edge 272 can be described as a touch free distance sensor supported from side plate 48 of milling machine 110. In examples, side plate 48 to which sensor 270 is mounted is configured to operate in previously milled area 282. Sensor 270 can be directed transverse to the direction of travel of milling machine 110. A second identical sensor can be supported from the opposite side plate 48.

It is noted that all the profile sensors described above can be described as involving machine observation of the profile parameter. Machine observation means through the use of sensors and not via human measurement or human observation of the surface profile.

Figure 10:
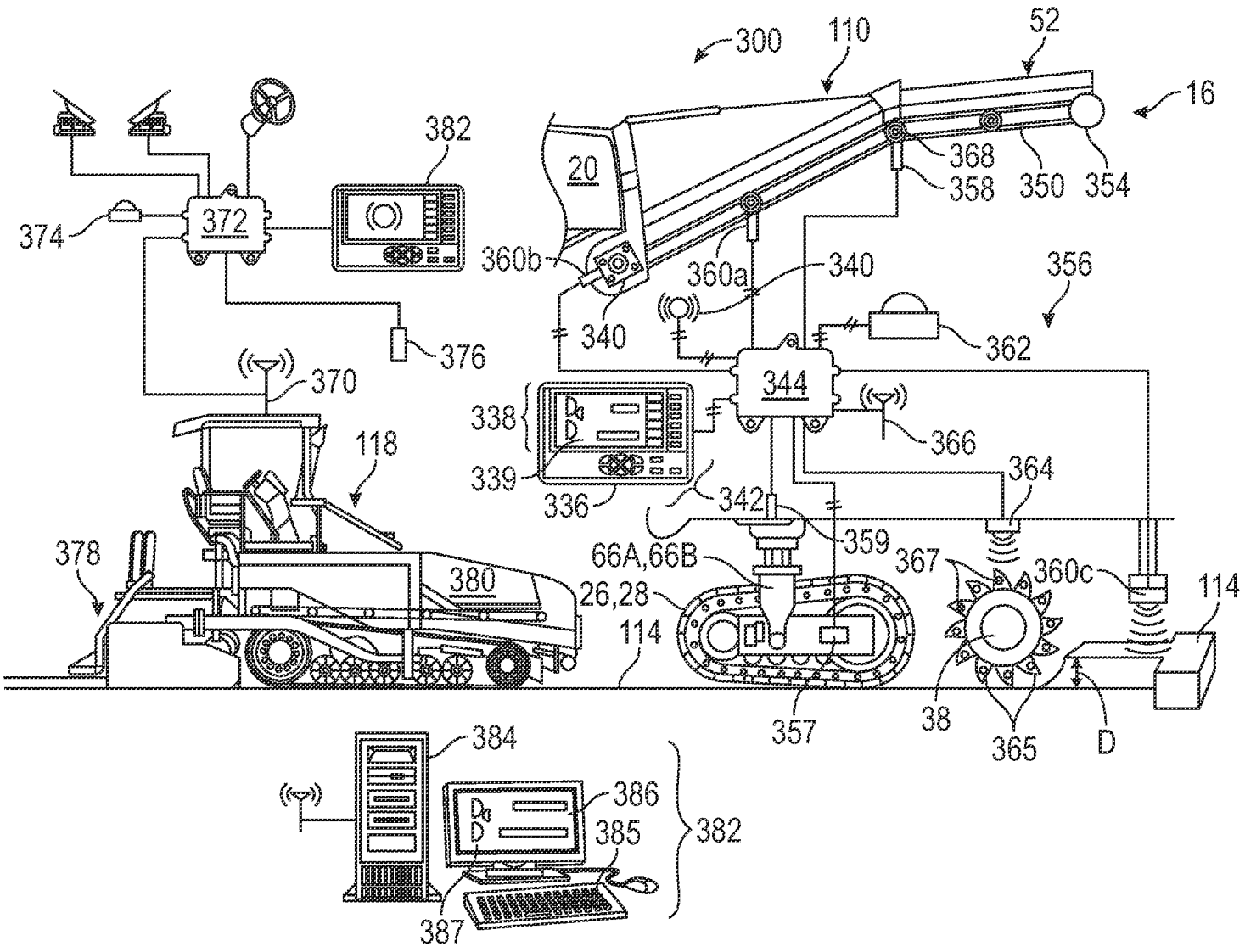
FIG. 10 is a diagrammatic illustration of a performance monitoring system of the present disclosure that can be used to track and monitor operations of the milling machine of FIGS. 2-5.

FIG. 10 is a diagrammatic illustration of partial-cut-width processing system 300 for milling machine 110. Partial-cut-width processing system 300 can comprise a system for transmitting sensor signals from milling machine 110 to back office 382 or another off-board computing system in order to process said sensor signals and monitor productivity of milling machine 110 and jobsites at which milling machine 110 are operating, amongst other things.

Partial-cut-width processing system 300 can comprise milling machine 110 of FIGS. 1 and 2 and paving machine 118, which can be positioned relative to surface 114, and back office 382 that can be located physically apart from milling machine 110 and paving machine 118.

Milling machine 110 can comprise frame 20, conveyor system 16, propulsion element 26, leg, or actuator, 66A and cutter drum 38. Conveyor system 16 can comprise conveyor 52, motor 354, belt 350 and pulleys 368. Cutter drum 38 can comprise cutting bits 365 and transmitters 367. Milling machine 110 can further comprise control system 356, which can comprise input device 342, controller 344, warning device 340, sensors 360*a*, 360*b*, 360*c*, locating device 362, bit wear sensor 364, communication device 366, depth sensor 359, ground speed sensor 357 and conveyor speed sensor 358. Input device 342 can comprise graphical user interface 338, interface device 336 and graphical output 339.

Paving machine 118 can comprise communication device 370, controller 372, locating device 374, sensors 376, screed 378 and hopper 380.

Back office 382 can comprise off-board computer 384, interface device 385 and graphical user interface 386, which can produce graphical output 387.

Display 338 can be configured to render the location of milling machine 110 (e.g., of cutter drum 38) relative to features of the jobsite (e.g., milled and/or un-milled parts of surface 114), and to display data and/or other information to the operator. Warning device 340 can be configured to audibly and/or visually alert the operator of milling machine 110 as to a proximity of cutter drum 38 to the worksite features, and/or when certain pieces of data exceed an associated threshold. Input device 342 can be configured to receive data and/or control instructions from the operator of milling machine 110. Other interface devices (e.g., control devices) can also be possible, and one or more of the interface devices described above could be combined into a single interface device, if desired.

Input device 342 can be, for example, an analog input device that receives control instructions via one or more buttons, switches, dials, levers, etc. Input device 342 can also or alternatively include digital components, such as one or more soft keys, touch screens, and/or visual displays. Input device 342 can be configured to generate one or more signals indicative of various parameters associated with milling machine 110 and/or its surrounding environment based on input received from the operator.

As illustrated in FIG. 10, control system 356 can be associated with milling machine 110 and include elements that cooperate with back office 382 to monitor and analyze the transfer of milled material into haul truck 120 (FIG. 1) and facilitate communication between milling machine 110 and paving machine 118 and/or between milling machine 110 and haul trucks 116, 120. For example, elements of control system 356 can cooperate with back office 382 to generate data related to a milling rate of milling machine 110 that can be transmitted to back office 382 to actually determine the milling rate. The milling rate of milling machine 110 can be a mass flow rate in and/or a volume flow rate (V) of milled material being discharged by milling machine 110 into haul truck 120. The milling rate can be determined with respect to time, distance, or another reference parameter, as desired. Control system 356 or off-board computer 384 can be configured to determine a total amount (e.g., a total weight W or total volume V) of material that has been milled and/or transferred over a period of milling time, a fill level Σ of haul truck 120, an amount of remaining time TF until haul truck 120 is full, and/or other statistical information. In this way, one or more of control system 356 of milling machine 110 and off-board computer 384 of back office 382 can cooperate to evaluate and monitor performance of milling machine 110 without having to burden controller 344 of milling machine 110.

Elements of control system 356 can include interface devices 336, ground speed sensor 357, conveyor speed sensor 358, depth sensor 359, one or more material measurement sensors 360*a-c* ("sensors"), locating device 362, bit wear sensor 364, communication device 366, and controller 344 electronically connected with each of the other elements. Elements of control system 356 can be configured to generate signals indicative of operating parameters associated with milling machine 110 that can be used by one or both of control system 356 and off-board computer 384 for further processing. These signals, e.g., raw sensor data, can be sent off-board milling machine 110 via communication device 366 for jobsite management and for back-office analysis. In turn, these signals can be processed by off-board computer 384, converted into useful data relating to the performance of milling machine 110, which can then be transmitted to milling machine 110, paving machine 118 and haul trucks 116, 120. Information, including the mass flow rate ($\dot{m}$), volume flow rate ($\dot{V}$), total weight W, total volume V, fill level Σ and remaining time TF can then be shown to the operator of milling machine 110 via display 338 and used by the operator and/or controller 344 to regulate operating parameters of milling machine 110 (e.g., travel speed, drum rotational speed, milling depth, milling rate, etc.) and/or to dispatch haul trucks 116, 120.

One or both of control system 356 and off-board computer 384 can be configured to determine the fill level Σ of haul truck 116 based on the mass flow rate, volume flow rate ($\dot{V}$), and/or the total weight W or volume V of the milled material in conjunction with known features of haul truck 120 (e.g., geometry, volumetric capacity, shape, tare weight, weight limit, etc.). Using this information and the signals from one or more of sensors 360*a-c*, control system 356 and/or off-board computer 384 can be configured to determine the remaining time TF until haul truck 116 is full (i.e., reaches a threshold, reaches a desired fill level, etc.). For example, off-board computer 384 can compare the mass flow rate ($\dot{m}$), volume flow rate ($\dot{V}$), total weight W, and/or fill level Σ to a weight limit, volumetric capacity, and/or target fill level of haul truck 116 over a period of conveying time, and determine how much time remains until transport vehicle will become full. This information can be used to determine when to dispatch empty haul trucks 120 to milling machine 110 or full haul trucks 116 carrying fresh paving material to paving machine 118.

Speed sensor 358 can be configured to generate a signal indicative of a linear belt speed of belt 350. For example, speed sensor 358 can be a shaft-driven sensor that is attached to pulley 368 of conveyor system 16. Pulley 368 can be in contact with belt 350 and can be driven by motor 354. Pulley 368 can alternatively be a free-wheeling pulley, such as an idler, tensioner, or other type of pulley. Speed sensor 358 can alternatively be attached directly to a shaft of motor 354, and its signal can also be indicative of the speed of motor 354. In some embodiments, multiple speed sensors 358 can be utilized and their outputs processed by control system 356 and/or off-board computer 384 in order to reduce inaccuracies caused by slipping of belt 350. Speed sensor 358 can detect the speed of a shaft or wheel using magnetic, optical, pulsating, or other type of sensing element. Signals generated by speed sensor 358 can be communicated to control system 356 and/or off-board computer 384 for processing.

Depth sensor 359 can be configured to generate a signal indicative of a depth D of cutter drum 38 below surface 114. That is, depth sensor 359 can generate a signal indicative of the cutting depth of milling machine 110. In some examples, depth sensor 359 can be associated with legs 66A, 66B and configured to generate a signal that can be used by controller 344 and off-board computer 384 to determine a distance to other machine features, such as milling chamber 34 or side plates 48 based on the position of legs 66A, 66B in conjunction with known information (e.g., known offsets between frame 20 and cutter drum 38). In other examples, depth sensor 359 can be configured to generate a signal indicative of a relative position of cutter drum 38 with respect to frame 20 or another reference component of milling machine 110.

Sensors 360*a-c* can include one or more sensors and/or systems of sensors configured to generate signals indicative of an amount of material being milled and/or transferred into haul truck 116 via conveyor system 16. For example, sensor 360*a* can be a belt scale. That is, sensor 360*a* can include a force transducer that is configured to measure a normal force applied to belt 350 by the weight of material on conveyor system 16. In examples, sensor 360*a* can determine the amount of material being transferred by conveyor 52 without contacting any moving parts of conveyor 52. The signal generated by sensor 360*a* can be utilized by off-board computer 384 and controller 344 in conjunction with the signal generated by speed sensor 358 and/or other sensors (e.g., an inclinometer) to determine the mass flow rate it and/or a volume flow rate ($\dot{V}$) of milled material being transferred into haul truck 120.

Sensor 60*b* can be configured to generate a signal indicative of an operating parameter that can be used to determine how much power is used to drive conveyor 52. For example, sensor 360*b* can be configured to measure a hydraulic pressure differential, an electrical voltage, or another parameter of motor 354. The signal generated by sensor 360*b* can be utilized by off-board computer 384 and controller 344 in conjunction with other parameters (e.g., hydraulic fluid flow rate, motor speed, motor displacement, electrical resistance, electrical current, etc.) to determine the power used to drive conveyor 52. The power used to drive conveyor 52, along with other parameters (e.g., the size and speed of pulley 368, angle of inclination of conveyor 52, etc.) can be utilized by off-board computer 384 and controller 344 to determine the milling rate (e.g., mass flow rate ($\dot{m}$) and/or a volume flow rate ($\dot{V}$) of milling machine 110.

Sensor 360*c* can embody a sensor or system that is configured to determine a cutting depth D in front of cutter drum 38. For example, sensor 360*c* can include a radioactive detection system, a laser scanning system, an optical scanner, a camera, an ultrasonic sensor, or another type of sensor that is configured to generate a signal indicative of a length (e.g., a width, a height, a depth, etc.), an area, or a volume of material milled by cutter drum 38. Other types of sensors or sensing systems can be used, if desired. Signals generated by sensors 360*a-c* can be utilized by off-board computer 384 and controller 344 in conjunction with other parameters (e.g., belt speed) to determine the milling rate of milling machine 110 (e.g., mass flow rate ($\dot{m}$) and/or a volume flow rate ($\dot{V}$) of milled material). In examples, output of sensor 360*c* can also be used determine the amount of material being transferred by conveyor 52 without contacting any moving parts of conveyor 52.

Locating device 362 can be configured to generate a signal indicative of a geographical position of the milling machine 110 relative to a local reference point, a coordinate system associated with the work area, a coordinate system associated with Earth, or any other type of 2-D or 3-D coordinate system. For example, locating device 362 can embody an electronic receiver configured to communicate with one or more satellites, or a local radio or laser transmitting system used to determine a relative geographical location of itself. Locating device 362 can receive and analyze high-frequency, low-power radio or laser signals from multiple locations to triangulate a relative 3-D geographical position. A signal indicative of this geographical position can then be communicated from locating device 362 to off-board computer 384 and controller 344. In examples, locating device 362 can comprise a global navigation satellite system (GNSS) signal, such as Global Positioning System (GPS) and Global Navigation Satellite System (GLONASS) signals.

Bit wear sensor 364 can be configured to detect when one or more cutting bits 365 attached to cutter drum 38 exceed a wear threshold. Cutting bits 365 can be configured to emit at least one signal via one or more transmitters 367 disposed within each cutting bit 365. Transmitters 367 can be sacrificial components disposed within cutting bit 365 at a depth below an outer surface such that transmitters 367 remain intact and emit a signal until cutting bit 365 becomes worn (i.e., wears beyond the threshold). When cutting bit 365 exceeds the wear threshold, transmitters 367 can become exposed. Once exposed, transmitters 367 can be destroyed and stop emitting signals or fall out of cutting bit 365. Each transmitter 367 can be, for example, a radio frequency identification (RFID) tag that emits a signal indicative of an ID. Bit wear sensor 364 can be configured to detect the signal emitted by each transmitter and communicate the signals to off-board computer 384 and controller 344. Transmitter 367 can be another type of transmitter capable of generating a signal from within cutting bit 365, if desired.

Communication device 366 can include hardware and/or software that enables sending and receiving of data messages between controller 344 and off-board computer 384 or another entity. The data messages can be sent and received via a direct data link and/or a wireless communication link, as desired. The direct data link can include an Ethernet connection, a connected area network (CAN), or another data link known in the art. The wireless communications can include one or more of satellite, cellular, Bluetooth, WiFi, infrared, and any other type of wireless communications that enables communication device 366 to exchange information.

Sensors of milling machine 110 can be in direct communication with controller 344 of milling machine, communication device 366 or off-board computer 384. As such, raw sensor data can be transmitted directly to control system 356 or to off-board computer 384 via communication device 366. Communication device 366 can thereafter receive processed sensor data for graphical output on display 338. Additionally, or alternatively, raw sensor data can be transmitted directly to controller 344 for processing and then to display 338 and/or communication device 366. In examples of the present disclosure, raw sensor data is transmitted off-board milling machine 110 for processing by off-board computer 384 and processed sensor data is returned to controller 344 in simplified form and with reduced resolution or frequency in order to minimize computational burden on controller 344. As such, communication device 366 can be capable of transmitting and receiving data with off-board computer 384.

Communication device 366 can be configured to communicate with paving machine 118 via a communication device 370 electronically connected to a controller 372 of paving machine 118. Communication signals and data can be communicated in both directions between communication device 366 and communication device 370. In this way, controller 344 of milling machine 110 can be configured to receive inputs and other information from controller 372 of paving machine 118, and vice versa. Such inputs can include, for example, one or more signals indicative of a position of paving machine 118, a paving rate of paving machine 118, an amount of available paving material for use by paving machine 118, an amount of available paving time, and or other information relating to the paving process being carried out by paving machine 118. For instance, paving machine 118 can include a locating device 374 configured to generate a signal indicative of the position of paving machine 118. The signal generated by locating device 374 can be indicative of an absolute position (e.g., a GPS coordinate location) or a relative distance (e.g., based on a laser-, an ultrasonic-, or a radio-based measurement system) between milling machine 110 and paving machine 118.

Paving machine 118 can also include one or more sensors 376 configured to generate signals indicative of parameters that can be used to determine the paving rate of paving machine 118. Sensors 376 can include, for example, position sensors associated with components of screed 378 attached to paving machine 118. The signals generated by sensors 376 can be indicative of or used to determine the height of screed 378 above surface 114, the width of screed 378, and/or the angle of one or more screed plates with respect to surface 114. Based on these signals and in conjunction with other information (e.g., the groundspeed of paving machine 118, the density of the paving material, etc.), controller 372, off-board computer 384 or controller 344 can be configured to determine the paving rate (e.g., volumetric flow rate, mass flow rate, etc.) of paving machine 118. The paving rate of paving machine 118 can be an amount of paving material (e.g., a weight, a mass, a volume, etc.) laid down on surface 114 with respect to a reference parameter, such as time or distance.

The amount of available paving material can be an amount of paving material available within a hopper 380 of paving machine 118, material available within haul truck 116 (referring to FIG. 1), or material available from a paving material plant for a given period, such as a particular day, shift, or project. In some cases, the amount of available material can be transmitted to paving machine 118 from a communication device at the plant, which can then be transmitted to milling machine 110. In other cases, the amount of available paving material can be transmitted directly to milling machine 110.

The amount of available paving time can be determined by worksite personnel or dictated by job constraints, such as an amount of time allotted by a customer or regulatory body. For example, paving time can be limited to time between morning and evening rush hours, off-peak usage times, daylight or nighttime hours, etc. The amount of available paving time can be entered via an interface device 336 (FIG. 10) associated with paving machine 118, via interface device 336 of cold planer, or provided by an off-board entity, such as an off-board computer 384. Other operating parameters of paving machine 118, such as a ground speed, a heading, an operational status (e.g., running, stopped, malfunctioning, etc.), or other information can also be communicated to, from and paving machine 118, milling machine 110 and off-board computer 384.

It is noted that any information provided to milling machine 110 via communication device 366 from paving machine 118 can alternatively be provided by off-board computer 384. For instance, any information generated by paving machine 118, such as the position, paving rate, and speed of paving machine 118, can be communicated from paving machine 118 to off-board computer 384, and then from off-board computer 384 to milling machine 110. Information from milling machine 110 can additionally be transmitted to paving machine 118 by both methods. Information relating to the paving process, such as the amount of available paving time and material, the density of the paving material, jobsite plans, etc., can flow between milling machine 110, paving machine 118 and off-board computer 384 in multiple directions. As discussed herein, raw sensor data from milling machine 110 and paving machine 118 can flow to off-board computer 384 and sensor data processed by off-board computer 384 can flow to milling machine 110 and paving machine 118.

Off-board computer 384 can be any type of back-office computer, laptop computer, cellular phone, personal digital assistant, tablet, dedicated hardware device, or other type of stationary or mobile computing device configured to communicate information via a wired or wireless connection. A back-office computer can be located at or in close proximity to the job site of milling machine 110 and paving machine 118 or can be located remotely from such job site. In examples, back-office computer 384 is physically separate from any physical component of milling machine 110 such that the only link between back-office computer 384 and milling machine 110 is an electronic communication signal, thereby allowing milling machine 110 to move about freely while back-office computer 384 can remain stationary.

Controller 344 can embody a single microprocessor or multiple microprocessors that include a means for monitoring operator and sensor input, and responsively adjusting operational characteristics of milling machine 110 based on the input. For example, controller 344 can include a memory, a secondary storage device, a clock, and a processor, such as a central processing unit or any other means for accomplishing a task consistent with the present disclosure. Numerous commercially available microprocessors can be configured to perform the functions of controller 344. It should be appreciated that controller 344 could readily embody a general machine controller capable of controlling numerous other machine functions. Various other known circuits can be associated with controller 344, including signal-conditioning circuitry, communication circuitry, and other appropriate circuitry. Controller 344 can be further communicatively coupled with an external computer system, instead of or in addition to including a computer system, as desired.

Controller 344 and/or off-board computer 384 can be configured to determine how much time remains until maintenance is needed by tracking the signals generated by transmitters 367 that are detected by bit wear sensor 364 over time. For instance, signals detected by bit wear sensor 364 can be indicative of wear levels of cutting bits 365 that change over time, from which controller 344 can extrapolate the amount of time TT until the cutting bits 365 will be fully worn. The amount of time required to inspect and/or replace the worn cutting bits 365 can be a predetermined or estimated amount of time stored in the memory of controller 344, which can also be increased or decreased based on a number of cutting bits 365 that require inspection or replacement, as determined by the signals received from bit wear sensor 364.

Controller 344 and/or off-board computer 384 can also or alternatively consider other operating parameters when determining the target distance DT, if desired. For example, controller 344 can receive signals from other sensors associated with milling machine 110, such as a fuel level sensor, an oil level sensor, an oil pressure sensor, a coolant temperature sensor, water level sensors for tanks of onboard water for cooling cutting bits 365 and/or other sensors. Controller 344 can track the signals generated by one or more of these other sensors over time and extrapolate the amount of time remaining TT until those parameters reach a threshold at which maintenance procedures associated with the detected parameters are required. Such procedures may include, for example, a refueling procedure, an oiling procedure, a repair procedure, or another maintenance task. Controller 344 may also account for the required time to carry out these procedures based on known time values stored within its memory or entered by personnel via interface device 336.

For example, controller 344 and/or off-board computer 384 can be configured to generate a model of the space to be filled by paving machine 118 based on the depth D of cutter drum 38, a width of the cutter drum, and the position of milling machine 110 over a period of milling time. That is, controller 344 can continually track the depth D of cutter drum 38 and multiply the depth D by the width of cutter drum 38, which can be a known value stored within memory, to continually determine a cut area of cutter drum 38. The cut area can be multiplied by a change in travel distance of milling machine 110, as determined by the difference between a first and a subsequent location signal generated by locating device 362 or through the use of ground speed sensor 357, in order to determine a cut volume. Iterative calculations of the cut volume can be performed over a period of milling time and compiled with respect to the location of milling machine 110 to generate a volumetric model of the space milled by milling machine 110, which is to be filled by paving machine 118. The model can be indicative of the total volume of space to be paved and include detailed depth and width data along the length of the modeled space.

Figure 11:
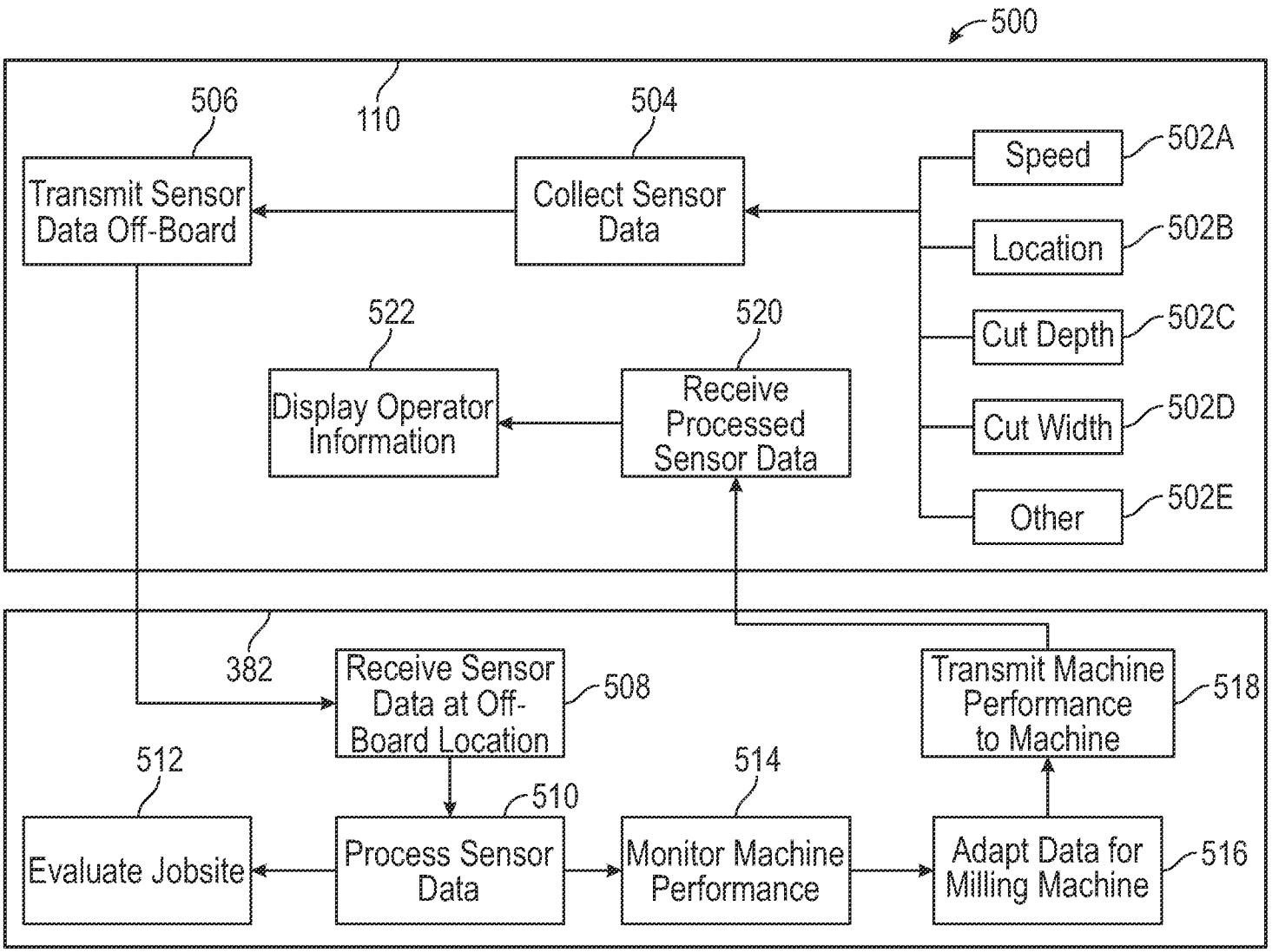
FIG. 11 is a line diagram showing methods for obtaining and transmitting milling machine operating data from a milling machine to an off-board location for processing.

FIG. 11 is a line diagram showing method 500 for monitoring productivity and evaluating performance of milling machine 110, including determining partial-cut-width and milled material volume of milling machine 110, such as can be done with the systems and methods described herein.

At steps 502A-502E, one or more of various operating parameters of milling machine 110 can be monitored. For example, one or more on-board sensors of milling machine 110 can be used to collect data relating to one or more operations of milling machine 110. In particular, speed of milling machine 110 relative to the ground can be monitored using, for example, speed sensor 357 (FIG. 10) at step 502A. Speed sensor 357 can comprise a conventional speedometer. In examples, speed of milling machine 110 can be determined using a sensor coupled to one or more propulsion elements 26 and 28 or a prime mover of milling machine 110, such as an engine. In additional examples, the speed of milling machine 110 can be determined using a positioning sensor, such as one described with respect to step 502B.

At step 502B, the location of milling machine 110 can be determined using a global navigation satellite system (GNSS), such as Global Positioning System (GPS) and Global Navigation Satellite System (GLONASS). In examples, locating device 362 can be used to determine position and speed of milling machine 110.

At step 502C, the cutting depth of cutter drum 38 can be sensed using, for example, sensor 360*c*. Sensor 360*c* can comprise an ultrasonic, magneto-resistive, acoustic or laser sensor configured to provide an indication of depth $d_0$, for example.

At step 502D, the cutting width of cutter drum 38 can be sensed using any of the methods described herein, such as partial-cut-width sensor system 18 (FIG. 2) or laser scanners, as well as other methods.

At step 502E, various other sensor inputs can be monitored. For example, sensor outputs related to sensor 360*a* for collecting weight information on belt 350, sensor 360*b* for collecting operating parameters of motor 354, speed sensor 358 relating to conveyor 52, and bit wear sensor 364 for collecting wear parameters of one or more cutting bits 365 can be monitored.

At step 504 data from each of the sensors of milling machine 110 can be collected. In examples, the data can be collected by controller 344 onboard milling machine 110. Raw data of the sensors of steps 502A-502E can be transmitted to controller 344 via various wired or wireless communication systems. Raw data can comprise data collected by a sensor that has not been processed or analyzed to determine a parameter of milling machine 110. That is raw sensor data can be un-associated with milling machine 110. However, raw sensor data can be conditioned or filtered for use or clarity by the sensor itself or a processor directly associated with (e.g., wired to) the sensor.

At step 506, data from each of the sensors of steps 502A-502E can be transmitted off-board of milling machine 110. In examples, controller 344 can transmit data from the sensors to communication device 366. Communication device 366 can use various wireless protocols as described herein. In additional examples, sensors of steps 502A-502E can transmit data directly to communication device 366 without the assistance of controller 344. In additional examples, sensors of steps 502A-502E can transmit data directly to a communication device of off-board computer 384. Data transmitted at step 506 can be individually time-stamped by each sensor that generates the data for later reassembly.

At step 508, data transmitted from milling machine 110 can be received by at an off-board location. An off-board location can comprise any location not-physically coupled to milling machine 110. Examples of off-board locations can comprise a mobile computing device located at the same job site as milling machine 110. Additional examples of off-board locations can comprise desktop or notebook computers located in an office setting. Step 508 can comprise multiple locations. Data can be received wirelessly using any of the protocols described herein. In other examples, data can be received through a wired connection. Data received by off-board computer 384 can be reassembled and aggregated, such as by piecing together data streams from individual sensors into a single timeline.

At step 510, data from the sensors of steps 502A-502E can be processed at the off-board location by a computing device such as a CPU of the device. Processing of the sensor data can comprise manipulating or transforming the raw sensor data into useful or contextualized information. Such information can provide a real-world explanation, magnitude or description of the parameter being sensed by the sensor relative to milling machine 110. Such information can then be analyzed to evaluate the performance of a jobsite, or parts thereof, or to evaluate individual machines, such as milling machine 110. For example, raw depth or width information can simply comprise data indicative of units of measure indicating a length. The off-board computer can contextualize such information by correlating the length to a length of pavement used in a volume calculation. As such, the raw sensor data does not provide a complete picture of the performance characteristic of milling machine 110 with other information being added to it.

At step 512, a jobsite, such as that of FIG. 1, can be evaluated. Data relating to efficiency of milling machine 110, paving machine 118 and haul trucks 120 and 116 can displayed to a user at back office 382, such as a graphical output on a video display device or the like. Jobsite performance can comprise whether or not adequate haul trucks are being used to keep up with milling machine 110 and paving machine 118, and whether milling machine 118 is keeping up with paving machine 110. Data relating to the performance of the jobsite and the machines used therein can be displayed on user interface 386 in tabular or graphical form, for example.

At step 514, performance of milling machine 110 can be evaluated, determined or analyzed, such as by displaying information relating to milling machine 110 on a video display device. Raw sensor data processed by back-office computer 384 can be displayed at user interface 386. For example, the milling rate and volume of milled material of milling machine 110 can be displayed in tabular or graphical form. The performance of milling machine 110 at step 514 can facilitate jobsite evaluation at step 512.

At step 516, data relating to the operation and performance of milling machine 110 can be prepared for transmission to milling machine 110. For example, the data can be put into a format useable by hardware and software of controller 344. Thus, robust data sets generated at off-board computer 384 can be pared down for use by milling machine 110. For example, the resolution of the data can be decreased, e.g., made less granular, or the rate at which data is transmitted to milling machine 110, e.g., the refresh rate, can be throttled or scaled back relative to, for example, the rate at which off-board computer 384 receives data from milling machine 110.

At step 518, a communication device of back-office computer 384 can transmit processed and adapted sensor data to milling machine 110, using any suitable remote, wireless or wired communication protocol.

At step 520, processed and adapted sensor data can be received by milling machine 110. For example, controller 344 can receive the data with the assistance of communication device 366. The data can be received in a format suitable for use with controller 344, which can be a different format than produced by the sensors of steps 502A-502E and different than a format suitable for use by off-board computer 384.

At step 522, data received by communication device 366 can be displayed on interface device 336. As discussed, such data can comprise milling rate, volume of milled material, mass or weight of milled material and the like. The displayed information can comprise, tabular or graphical formats.

INDUSTRIAL APPLICABILITY

The present application describes various systems and methods for milling machine sensing, such as partial-cut-width sensing, depth sensing and speed sensing, that can be used in milling machines, such as cold planers, that can operate to remove old or degraded paving material from roadway surfaces. The milling machines described herein can include sensing systems that can be used to generate data sets for further processing. In examples, raw data can be sent off-board from the milling machine, such as to a back-office location, a mobile computing device or the like. As such, the data can be processed using computing device having more robust processing power and memory. Additionally, such device can be updated with the latest software more easily and more frequently than can the hardware onboard the milling machine. As such, the computing power available on the milling machine can be readily available for operating the milling machine. Additionally, the expense of the milling machine can be kept down by elimination the need for sophisticated computing packages, including hardware and software. Thus, in examples, the on-board computing system or controller of the milling machine does not perform productivity evaluations. However, in additional examples, the onboard computing system of the milling machine can be configured to perform productivity measurements. Such measurements can be used to track the efficiency of operations of the cold planer machines. Productivity measurements can, for example, help estimate milling bit usage and the time it will take to complete a milling operation. Sophisticated off-board computing systems can more readily handle multiple data streams in real time and provide more accurate output for both productivity monitoring and performance evaluations. Thus, cost savings can be achieved by, for example, reducing the cost associated with replacing milling bits and labor time associated with changing milling bits, as well as reducing the length of time it takes to complete a paving operation by better coordinating milling and paving machines and haul trucks.

In examples, back-office computer 384 can then determine the milling rate of milling machine 110 based on signals from sensors 358 and one or more of sensors 360*a-c*, and receive a signal indicative of the paving rate of paving machine 118 from controller 372 via communication device 366. After comparing the milling rate and the paving rate, back-office computer 384 can determine the performance of milling machine 110 and paving machine 118 to evaluate jobsite performance. Back-office computer 384 can simultaneously receive maintenance signals from other sensors, such as bit wear sensor 364, and determine how much time remains until milling machine 110 may need to be stopped to receive maintenance based on the signals. These maintenance signals may also include information, such an amount of time milling machine 110 is expected to wait for an empty haul truck 120 to reach worksite 112 before milling machine 110 can continue milling surface 114.

As milling machine 110 mills surface 114, back-office computer 384 can constantly track the depth and width of cutter drum 38 and generate a model of the milled space over the distance traveled by milling machine 110 during the milling operation. The model can be a 3-D model that accurately accounts for the volume of space to be filled in by paving machine 118. In this way, surveyors can be relieved of the duty of constantly determining the progress of milling machine 110 during the resurfacing operation.

Back-office computer 384 can also use the model of the milled space in conjunction with other known information (e.g., the density of the fresh paving material) to determine whether the amount of paving material required to fill in the milled space exceeds the amount of available paving material. For example, back-office computer 384 can receive a signal indicative of the amount of available paving material from a material production plant, off-board computer 384, or paving machine 118 via a communication device, and determine whether the amount of available paving material is sufficient to fill in the volume of space milled by milling machine 110. When the amount of available paving material is insufficient, back-office computer 384 can automatically reduce the milling rate of milling machine 110, or generate graphical objects on display 338 that are indicative of the difference between the amount of required paving material and the amount of available paving material. In this way, back-office computer 384 can automatically or the operator may be assisted to manually prevent more material from being milled than can be replaced.

What is claimed is:

1. A system for determining and monitoring output of a milling machine, the system comprising:

a cutting system having a cutting tool extending across a cutting path about a rotational axis;

a sensor positioned on the milling machine to sense a performance parameter of the cutting tool and generate raw sensor data;

a communication device electronically coupled to the sensor to receive the raw sensor data and transmit the raw sensor data to a remote location physically separate from and outside of the milling machine via a wireless communication signal; and a monitoring device located apart from and physically separated from the milling machine at the remote location, the monitoring device configured to receive the wireless communication signal including the raw sensor data and evaluate performance of the milling machine.

2. The system of claim 1, wherein the sensor comprises a milling sensor configured to sense one or more of a cutting depth and a cutting width of the cutting tool, wherein the milling sensor is further configured to determine a partial-cut width of material in front of the cutting tool from output of the milling sensor.

3. The system of claim 1, wherein the sensor comprises a three-dimensional scanner or a plurality of depth sensors.

4. The system of claim 1, wherein the sensor comprises a global navigation satellite system sensor configured to generate speed and location data for the milling machine.

5. The system of claim 1, wherein the monitoring device is configured to:

determine removed paving material volume;

output an indicator of removed paving material volume; and transmit the indicator to the communication device of the milling machine.

6. The system of claim 1, wherein the milling machine further comprises an operator interface configured to receive processed sensor data and render a graphical display of the processed sensor data.

7. The system of claim 1, wherein the monitoring device comprises a mobile computing device.

8. The system of claim 1, wherein the monitoring device comprises a computer at a back-office location.

9. A method for determining and monitoring output of a milling machine, the method comprising:

sensing an operating parameter of the milling machine with a sensor;

transmitting data from the sensors of the milling machine to an off-board location via a first wireless communication signal;

receiving the first wireless communication signal at the off-board location at a remote location physically separate from the milling machine;

determining a performance parameter of the milling machine from the data at the off-board location at the remote location;

transmitting the performance parameter to the milling machine via a second wireless communication signal originated at the remote location; and displaying the performance parameter on a display screen of the milling machine.

10. The method of claim 9, wherein sensing the operating parameter of the milling machine comprises sensing a partial-cut width of the milling machine.

11. The method of claim 10, wherein sensing the operating parameter of the milling machine further comprises sensing a cut depth and sensing a speed of the milling machine.

12. The method of claim 11, wherein transmitting data from the sensor off-board the milling machine comprises time-stamping data relating to the operating parameter, the cut depth and the speed.

13. The method of claim 9, wherein transmitting data from the sensor of the milling machine to an off-board location comprises transmitting raw sensor data.

14. The method of claim 9, wherein transmitting the performance parameter to the milling machine comprises throttling a refresh rate of data provided to the milling machine to decrease resolution of the data by transmitting data generated by the sensor to the remote location at a second rate less than a first rate at which the sensor collects data.

15. The method of claim 9, wherein transmitting data from the sensor of the milling machine to an off-board location comprises transmitting data from the sensor to a mobile computing device located at a jobsite of the milling machine.

16. The method of claim 9, wherein transmitting data from the sensor of the milling machine to an off-board location comprises transmitting data from the sensor to a stationary computing device located in a back-office location.

17. The method of claim 9, wherein transmitting data from the sensor of the milling machine to an off-board location comprises transmitting sensor data directly from a sensor to the off-board location via a sensor including a wireless communication device.

18. The method of claim 9, further comprising performing jobsite analysis of the milling machine and another machine based on the performance parameter.

19. The system of claim 2, further comprising an off-board computer at the remote location, wherein the off-board computer is configured to:

determine cut volume from the partial-cut width and the cutting depth at the remote location; and communicate the cut volume from the remote location to the milling machine for display.

20. The method of claim 11, wherein transmitting the performance para to the milling machine comprises:

determining cut volume from the partial-cut width and the cut depth at the remote location; and communicating the cut volume from the remote location to the milling machine for display.

* * * * *